United States Patent [19]

Kicherer et al.

[11] Patent Number: 4,818,846

[45] Date of Patent: Apr. 4, 1989

[54] ELECTRIC HOTPLATE AND APPARATUS FOR THE CONNECTION THEREOF

[75] Inventors: Robert Kicherer; Felix Schreder; Stefan Reif; Uwe Schneider, all of Oberderdingen, Fed. Rep. of Germany

[73] Assignee: E.G.O. Elektro-Geräte Blanc U. Fischer, Fed. Rep. of Germany

[21] Appl. No.: 930,491

[22] Filed: Nov. 12, 1986

[30] Foreign Application Priority Data

Nov. 16, 1985 [DE] Fed. Rep. of Germany ..... 3540816

[51] Int. Cl.[4] ..... H05B 3/68

[52] U.S. Cl. ..... 219/458; 219/463; 219/459; 219/471

[58] Field of Search ..... 219/458, 463, 471, 443, 219/444, 445, 459

[56] References Cited

FOREIGN PATENT DOCUMENTS

| | | |
|---|---|---|
| 196981 | 4/1958 | Austria . |
| 1165175 | 9/1964 | Fed. Rep. of Germany . |
| 1104087 | 1/1966 | Fed. Rep. of Germany . |
| 1270201 | 6/1968 | Fed. Rep. of Germany . |
| 1291032 | 10/1969 | Fed. Rep. of Germany . |
| 2515905 | 10/1976 | Fed. Rep. of Germany . |
| 2651848 | 7/1981 | Fed. Rep. of Germany . |
| 3301219 | 7/1984 | Fed. Rep. of Germany . |
| 424291 | 2/1935 | United Kingdom . |

*Primary Examiner*—Clifford C. Shaw
*Assistant Examiner*—M. M. Lateef
*Attorney, Agent, or Firm*—Steele, Gould & Fried

[57] ABSTRACT

The present invention relates to an apparatus for connecting appliance lines to cooking plates, hobs or hotplates. Our of the bottom of the electric hotplate, connecting pins (19*b*) extend for connection to connecting members (33) of a connecting piece (31) that is part of the appliance line. From a passage through an insulating member (20*b*) in the bottom of the hotplate, the connecting pins (19*b*) project outwards towards the circumference of the hotplate body (2*b*). In a transportation mode the pins can be resiliently and completely countersunk in the underside of the hotplate. In the vicinity of the front end of the connecting members (33) of the appliance plug, the connecting piece (31) of the plug has a threading and guidance apparatus for the connecting pins (19*b*) that does not project beyond the outer circumference of hotplate body (2*b*), thereby ensuring an automatic, positonally correct connection between the connecting piece (31) and connecting pins (19*b*).

67 Claims, 8 Drawing Sheets

FIG. 5
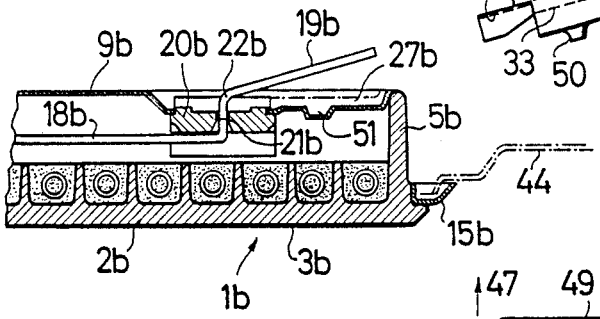
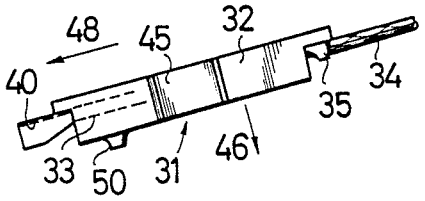
FIG. 6
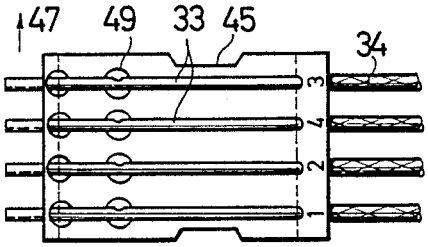
FIG. 4
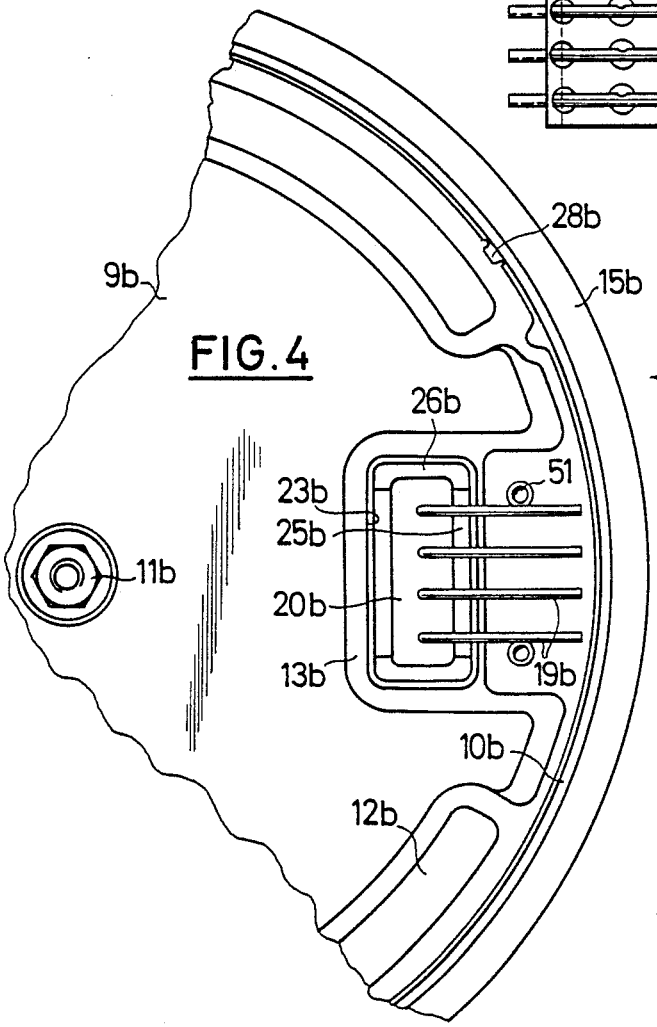
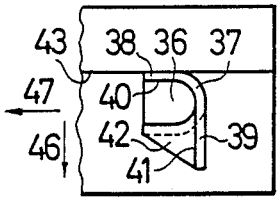
FIG. 7
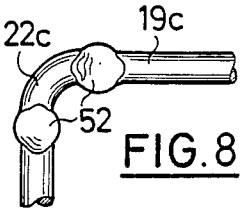
FIG. 8
FIG. 9
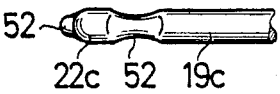

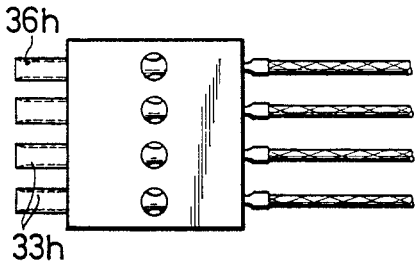
FIG.17
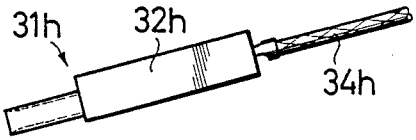
FIG.16
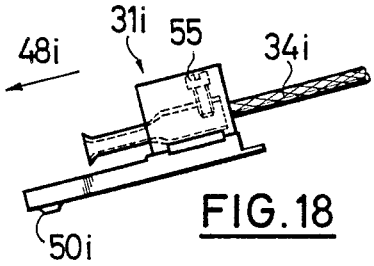
FIG.18
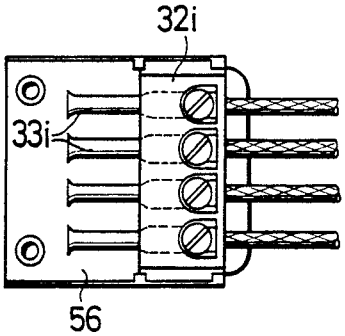
FIG.19
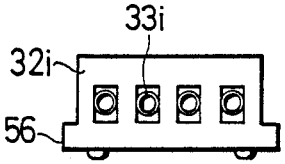
FIG.20
FIG.21
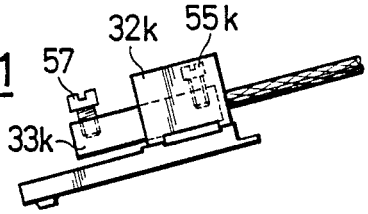
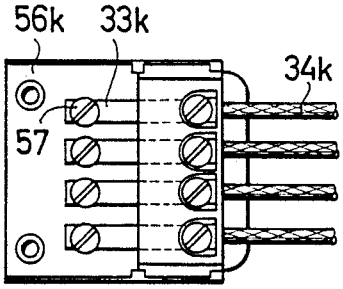
FIG.22
FIG.23
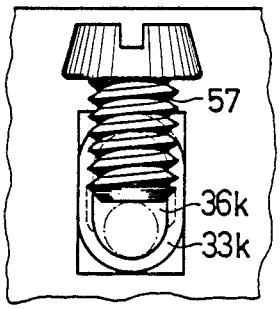

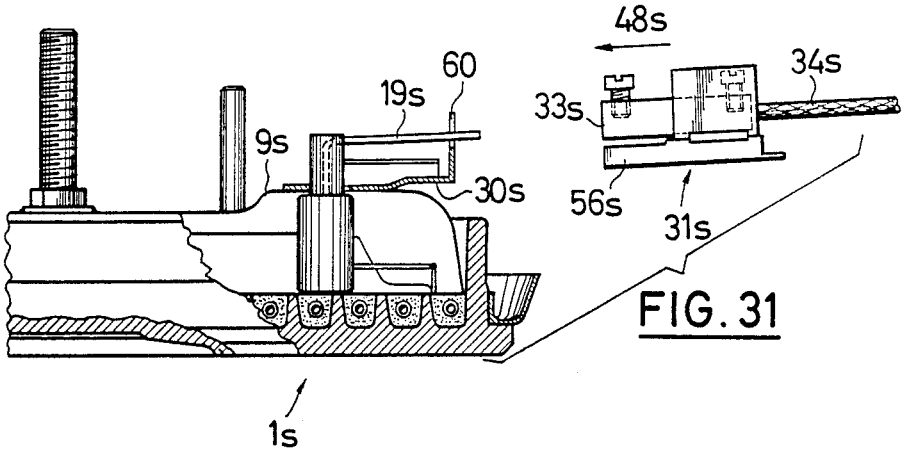
FIG. 31
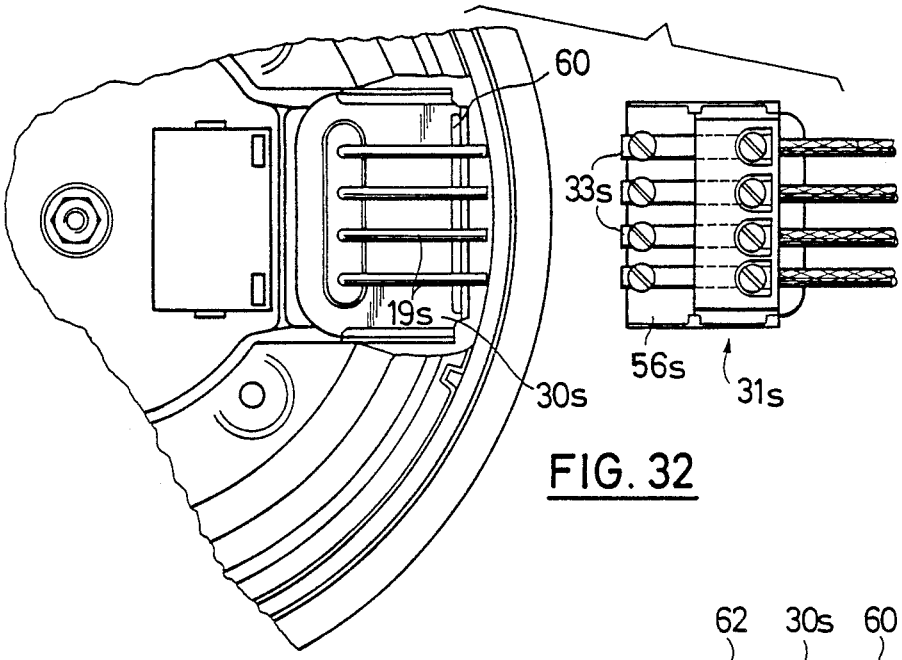
FIG. 32
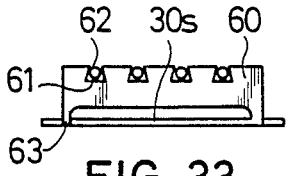
FIG. 33
FIG. 34
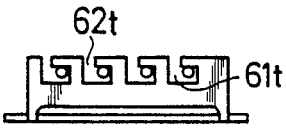
FIG. 35
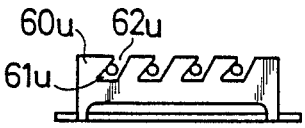

ELECTRIC HOTPLATE AND APPARATUS FOR THE CONNECTION THEREOF

BACKGROUND OF THE INVENTION

The present invention relates to an electric hotplate with a hotplate body and a lower cover with an insulating member for the passage of heating resistor leads, whose outer connecting portions located on the underside of the hotplate have their connecting ends constructed for the connection of appliance lines.

Such hotplates are generally fixed in a hob, sometimes known as a cooking plate or cooking station on a range, in such a way that they engage in a fitting or assembly opening thereof, are supported against reactions at the supports with respect to the edge of said opening and are connected to appliance lines on the underside of the hob or coating plate. The width of the fitting opening is generally only slightly larger than the greatest width of the hotplate body part engaging therein, which is generally determined by an outer, annular cast iron flange rim or edge of the hotplate body. For the fitting of the hotplate, which appropriately takes place in the inverted or upside-down position, i.e. with the hotplate at the bottom and the cooling at the top, importance is attached to the way in which the part of the hotplate passed through the fitting opening into the cooking is constructed. If said part has members projecting over the outer circumference of the hotplate, particularly connecting portions or flexible connecting portions as in the case of German Pat. No. 29 33 349, then it may be necessary to have a tilting position of the hotplates with respect to the hob for fitting purposes, which can make fitting more difficult, particularly in the case of the automation thereof. Howeover, if as in DE-OS 33 01 219 the connecting portions are formed by short stubs projecting over the insulating member, access to the connection of the tool lines can be relatively complicated, particularly if connection takes place by a welded joint.

SUMMARY OF THE INVENTION

The problem of the invention is to provide an electric hotplate of the aforementioned type which, in the case of a simple construction, ensures a much easier fitting in the cooling plate or the like, as well as a favourable connection of the appliance lines.

This problem is solved by constructing the connecting leads so as to at least partly form relatively rigid, but resiliently movable pin members which form substantially straight connecting pins which, by means of freely projecting ends, are directed substantially parallel outwards towards the circumference of the hotplate without projecting beyond the circumference. The inflexible connecting pins, which can only be deformed by applying relatively high bending forces, do not project sufficiently far forward that they prevent a bringing together of cooking plate and hotplate axially parallel to the central axis of the fitting opening, but project at right angles to the central axis of the hotplate in such a way that, from the outer circumference thereof and e.g. in an insertion or plugging movement can be connected to the appliance lines, any minor positional variations with respect to the connecting members being compensated by their resilient mobility.

The inventive hotplate can be constructed that, e.g. whilst interposing cardboard coated with a foam sheet or a similar flat body it can be stacked in superimposed manner with similar or identical hotplates in such a way that the superimposed hotplates are equiaxial to one another. The hotplates can be alternately supported on one another by their cooking faces and their undersides, or they can be stacked with the same orientation in such a way that in each case adjacent hotplates face one another with a cooking surface and an underside, the bottom hotplate being appropriately arranged with downwardly directed cooking surface. The said stacks, which permit transportation and storage in a confined space are particularly possible if there is at least one reception depression for the connecting pins in the cover, so that in a transportation position they at the most extend downwards to the underside of the hotplate, but on releasing the stacking pressure resiliently, appear over the underside of the hotplate. The connecting pins then move e.g. their free ends move a few degrees away from the underside of the hotplate, so that access thereof is particularly favourable for the connection to the appliance lines directed parallel to the longitudinal direction thereof.

The inventive construction also advantageously makes it possible to take account of the conventionally occurring disadvantages resulting from relatively high temperatures occurring in the immediate vicinity of the bottom of the hotplate when the latter is being operated and which can damage or destroy both the connections and also the appliance lines. There is a considerable reduction to such temperatures even at relatively small distances from the bottom of the hotplate, so that through the inventive construction the connections and appliance lines can be located in an area where excessive temperatures do not occur. However, the leads are constructed in such a way that the entire length thereof is protected against high temperatures.

The problem of the invention is advantageously solved in that a common connection piece is provided for all the connecting pins having separate juxtaposed connecting members on an insulator and threading - guidance means for the connecting pins in the vicinity of the front ends thereof, so that also in the case of automated fitting it is possible to ensure in a simple manner a positionally correct connection between the connecting pins and the connecting piece or the appliance lines connected thereto. Thus, the connecting piece contributes to the positionally correct orientation of the connecting pins prior to final connection or prior to reaching its end position. For this purpose on the insulator and on the connecting members, or on both these parts, it is possible to provide guide surfaces, which are appropriately arranged in such a way that they have an orienting effect in at least two coordinate directions.

According to a further development of the invention with respect to the connecting member, the connecting piece has insulated connecting or orienting members for direct engagement in the hotplate, so as to permit in simple manner a precise positional alignment and optionally a direct bearing connection of the connecting piece with respect to the hotplate. In its connected position, appropriately a larger proportion of the total length of the insulator projects over the outer circumference of the hotplate, so that the appliance lines connected to its outer end are relatively remote from the hotplate and need not therefore be given a particularly heat-resistant construction.

Prior to fitting, the connecting pins can also be oriented in a positionally correct manner with respect to the hotplate by a separate centring member and, at a distance from the passage through the insulating member, the centering member engages on the connecting pins and appropriatiely leaves the ends thereof projecting freely at least over a short length. The centring member, which can be transferred from a stacking position into a fitting position, is advantageously so arranged that on connecting the connecting piece, it frees the connecting pins gradually over that total length by which they engage in the connecting piece.

The mechanical and electrically conductive connection between the connecting members and connecting pins can be brought about by resistance welding, spot welding, inert gas welding and particularly non-contact welding, such as laser welding. However, it can also be brought about by squeezing or crimping the connecting member, by clamping screws or by optionally redetachable plug connections, which is particularly advantageous if the hotplates have to be interchanged or replaced. In a similar manner, said connections are also suitable for connecting the connecting members to the appliance lines and for adapting to the particular requirements each of the possible combinations between the nature of the connection with the connecting pins and the nature of the connection with the appliance lines is conceivable.

The danger that the heating resistor leads can be torn away from their connection with the heating resistors during stacking the hotplate or during fitting through a movement of the connecting pins within the hotplate, can be considerably reduced in that the inner portions of the leads are so secured with respect to the hotplate that movements of the connecting pins are not transferred thereto.

The inventive hotplate is particularly appropriate for automatic stacking, as well as automatic fitting with the aid of robots. For this purpose, appropriately both the hotplate and the connecting piece or its insulator have in each case at least one positioning member, by means of which the position of the hotplate or connecting piece can be accurately recognized by the robot and this position can be fixed.

According to the invention an apparatus for fitting the connecting piece to the electric hotplate is characterized in that a gripper is provided, which moves the connecting piece in three coordinate directions with respect to the connecting pins, in order to successively bring the same into engagement with the guide surfaces, so that in a simple manner a precise alignment of the connecting pins relative to the connecting piece is obtained. In addition thereto or instead thereof, it can also be advantageous to provide a gripping and orienting device for the connecting pins and preferably two gripping jaws are provided, whereof at least one has a comb-like gripping face with centering cutouts for the connecting pins. In a simple manner, the centering cutouts can be prismatic, i.e. for example bounded in V-shaped manner.

These and further features of preferred developments of the invention can be gathered from the description and drawings and the individual features can be realized singly or in the form of subcombinations in an embodiment of the invention and in other fields.

BRIEF DESCRIPTION OF THE DRAWINGS

The invention is described in greater detail hereinafter relative to non-limitative embodiments and with reference to the attached drawings, wherein show:

FIG. 4 another embodiment in the form of a detail of FIG. 1.

FIG. 5 the hotplate of FIG. 4 in a fitting and connecting position with the associated connecting piece.

FIG. 6 the connecting piece of FIG. 5 in its position appropriate for FIG. 4.

FIG. 7 a detail of the connecting piece in a view of the connecting end according to FIG. 5.

FIG. 8 a detail of a lead on a larger scale and in side view.

FIG. 9 the detail of FIG. 8 in plan view.

FIGS. 16 and 17 a further embodiment of a connecting piece in representations corresponding to FIGS. 5 and 6.

FIGS. 18 and 20 another embodiment of a connecting piece in representations corresponding to FIGS. 12 to 14.

FIGS. 21 to 23 another embodiment of a connecting piece in representations corresponding to FIGS. 5 to 7.

FIGS. 31 and 32 another embodiment in representations corresponding to FIGS. 29 and 30.

FIG. 33 a detail of FIG. 31 in a longitudinal view of the connecting pins.

FIGS. 34 and 35 two further embodiments in representations corresponding to FIG. 33.

DETAILED DESCRIPTION OF THE PREFERRED EMBODIMENTS

Figure 1:
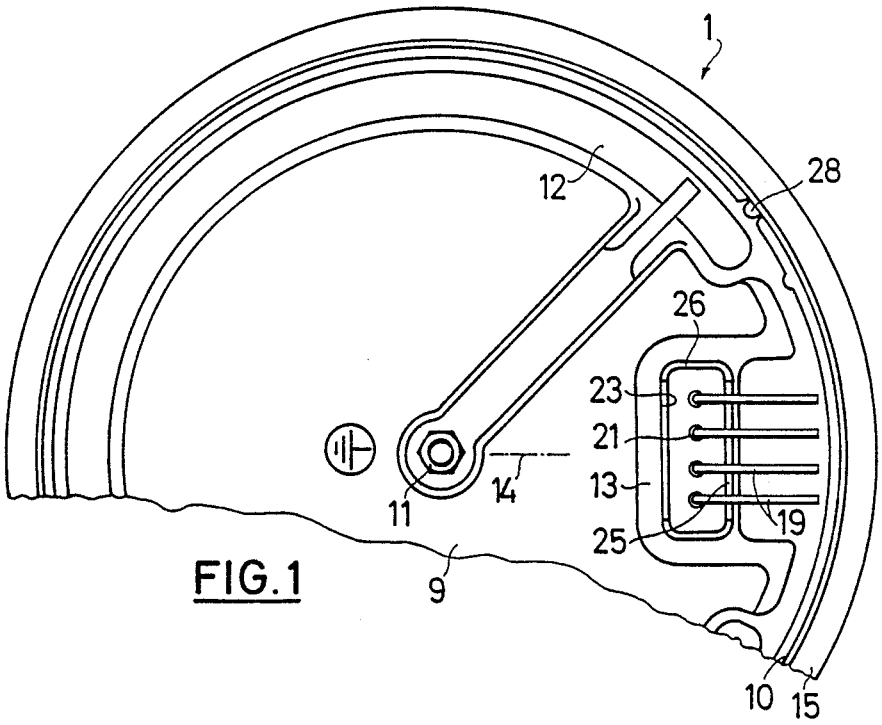
FIG. 1 a detail of an electric hotplate according to the invention in a view of the underside.
Figure 2:
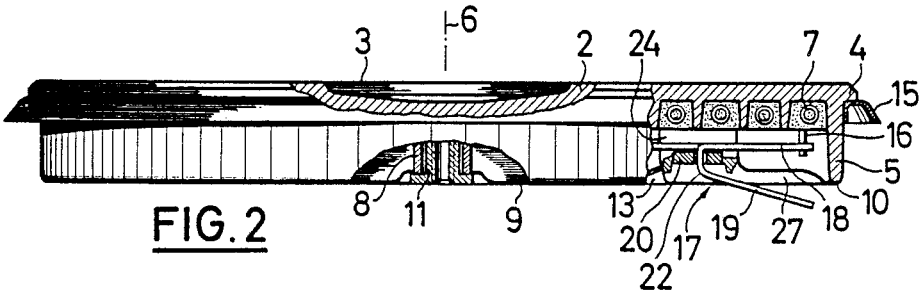
FIG. 2 the hotplate according to FIG. 1 in a part sectional side view.

The electric hotplate 1 according to FIGS. 1 and 2 has a one-part, cast iron hotplate body 2, whose top surface forms a planar cooking surface 3, which is centrally provided with a depression and is therefore circular, but is free from openings. The e.g. circular hotplate body 2 forms a circumferential collar connected to the cooking surface 3 and whose outer circumference determines the greatest width or diameter of hotplate body 2 and to whose underside is connected a jacket-like or apron-like flange edge or rim 5, which is slightly inwardly displaced with respect to the outer circumference thereof and whose lower end face determines the underside of the hotplate body 2. This outer flange edge 5, which is axially symmetrical to the central axis 6 of hotplate 1, projects downwards over the part of the underside of hotplate body 2 following on to the same towards central axis 6. One, two or more heating resistors 7 in the form of heater coils, embedded in contact-free manner with respect to hotplate body 2 in a mineral, compressed insulating material are placed in said part in slots running spirally about central axis 6 and which are separated from one another by correspondingly spiral, rib-like intermediate webs of the cast iron body. In the radially inner region of said zone in which the heating resistors 7 are placed, said zone can be bounded by an inner flange edge of the cast iron body corresponding to the outer flange edge 5, the inner flange edge appropriately projecting less far down than the outer flange edge. In the center, i.e. optionally with a radial spacing within the inner flange edge, the hotplate body 3 has a central stud 8 provided with a tap-hole and which projects over its underside by approximately the same amount as flange edge 5 or slightly less. The underside of electric hotplate 1 or the space surrounded by flange edge 5 is closed by a sheet metal cover 9, which enages with an outer ring rim 10 under tension on the lower end face of flange edge 5. The cover 9 formed by a lid-like stamped or deep-drawn part and whose outer circumference is formed by the edge face of ring rim 10 having roughly the same width as the outer circumference of flange edge 5 is tensioned against the lower end face of central stud 8 by a hollow screw or bolt 11 engaging in the central stud 8 and located in central axis 6, the head of hollow screw 11 being so countersunk in a depression in the bottom of cover 9, that the screw 11 does not project over the areas of the bottom of cover 9 essentially located in one plane. However, without significantly impairing stackability, hollow screw 11 can project by an amount over said bottom which corresponds to the depth of the central depression in cooking surface 3. Apart from the aforementioned planar underside or bottom, cover 9 exclusively has areas forming depressions on the underside, i.e. which are upwardly displaced with respect to the latter. The said areas are in particular formed by an approximately closed circular slot-like depression 12 immediately adjacent to the ring rim and a recess 13 approximately rectangularly bounded in a view from below and which in the vicinity of the opening of circular slot 12 is symmetrical to an axial plane 14 of the hotplate. A sheet metal support ring 15 is provided on the underside of the circumferential collar 4 or the lower circular shoulder formed by the latter. Ring 15 closely embraces the outer circumference of flange edge 5 over a small part of its height and serves to support hotplate 1 on the edge of the fitting opening in a hob or the like. Support ring 15 can be approximately U-shaped in cross-section, its outer ring leg appropriately in cross-section slopes downwards and outwards.

Heating resistors 7 have end pins 16 fixed to their ends and which project downwards out of the insulating bed and are entirely located in the space between the underside of hotplate body 3 and cover 9. The ends of inner portions 18 of heating resistor leads 19 are fixed to said end pins 16, said inner portions 18 running substantially linearly or parallel to the cooking surface 3 with a spacing between the bottom of the hotplate body and cover 9 between an insulating member 20 and the particular associated end pin 16. All and in the represented embodiment four leads 17 are led downwards out of the hotplate or through the cover 9 by means of juxtaposed passage openings 21 in insulating member 20 which are at right angles to cooking surface 3, said openings 21 on either side of axial plane 14 being located in a common plane at right angles thereto and insulating member 20 is approximately symmetrical to axial plane 14. Immediately adjacent to the inside of insulating member 20 or the associated end of the particular passage opening 21, portions 18 are bent in an approximately right angled manner and can be located with said bent part in substantially clearance-free manner in the particular opening 21. Immediately adjacent to the outside of insulating member 20 or connected to the outer end of passage opening 21, the particular lead 17 is again provided with a bend 22 in such a way that connected to said bend it forms an outer, linear connecting pin 19, which is parallel to axial plane 14 and is directed against the area of flange edge 5 closest to insulating member 20. Thus, in the vicinity of the passage through insulating member 20, leads 17 are bent in part approximately U-shaped and in part Z-shaped. The appropriately steatite insulating member 20 passes through a window-like opening, whose boundary closely surrounds the same, in the base of the recess 13 of cover 9 parallel to the underside and is supported with a shoulder face on the inside of the edge of cover 9 surrounding opening 23. By means of projections 24 projecting over its inside and located on either side of openings 21, insulating member 20 is also supported on the bottom of hotplate body 3 in the area where the heating resistors 7 are located. The outer ends of passage openings 21 are located in an area of insulating member 20 approximately in the plane of the bottom of recess 13 and is surrounded by an all-round, projecting edge, but which does not project up to the bottom of cover 9. Cutouts 25 are provided in the longitudinal sides of said edge 26 and the connecting pins 19 cross edge 26 at right angles in the vicinity of the associated cutout 25. Following on to recess 13, between the latter and ring rim 10 a less deep reception depression 27 is provided in the bottom of cover 9, which extends almost up to ring rim 10 and in which the connecting pins 19 can be resiliently pressed in such a way that they do not project over the underside of cover 9 and their ends almost extend up to the inner circumference of flange edge 5. In the relaxed state, connecting pins 19 are located in a common plane at right angles to axial plane 14, which slopes by a few radians towards the bottom of cover 9 or cooking surface 3, in such a way that the free ends of connecting pins 19 are removed from the bottom and are located by said free ends at a distance from the bottom of the remaining hotplate. All the connecting pins 19 are of the same length or sufficiently long for their free ends to be located in a common plane at right angles to axial plane 14.

The hotplate is provided on its under surface, namely in the lower end face of flange edge 5, with a positioning member 28 in the form of a cutout, in which the cover 9 engages with a cam shaped from its ring rim 10. Thus, the position of the cover is precisely fixed with respect to hotplate body 2 and during the fitting of the hotplate, the positioning member 28 ensures its positionally correct orientation with respect to central axis 6.

Figure 3:
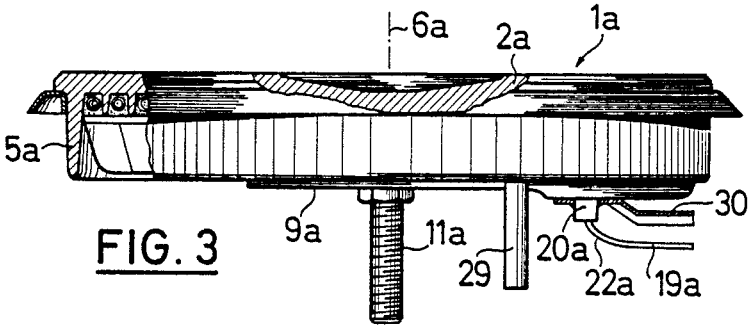
FIG. 3 another embodiment in a representation according to FIG. 2.

In the embodiment according to FIG. 3, hotplate 1*a* has parts projectings over the bottom of cover 9*a*, so that said hotplate is essentially only suitable for stacking with displaced central axes 6*a*. For fixing the hotplate 1*a* in the appliance a thread bolt 11*a* projecting downwards in central axis 6*a* is provided and is screwed into the central stud of hotplate body 2*a* and on which is placed a nut for fixing the cover 9*a* with respect to the hotplate body. Cover 9*a* is completely located within flange edge 5*a* and is tensioned in cup-shaped manner with a set-up edge within the flange edge 5*a* against the underside of the hotplate body or the zone having the heating resistors. To prevent the hotplate turning in the appliance and which in the embodiment according to FIGS. 1 and 2 can take place through a part which can be projected out of the transportation position over the underside of the hotplate, in the embodiment according to FIG. 3 there is at least one rotation prevention bolt 29 projecting over the underside adjacent to the stud 11*a*. Insulating member 20*a* also projects beyond the bottom of cover 9*a*, so that connecting pins 19*a* are completely below the bottom of cover 9*a*. Above connecting pins 19*a* is provided a mating connector 30 in the form of a sheet metal profile projecting freely with respect thereto, which is traversed by the insulating member 20*a* and is fixed to the bottom of cover 9*a*, e.g. by spot welding. The cross-sectionally U-shaped mating connector 30, whose free end projects outwards by roughly the same amount as connecting pins 19*a*, is located with its plugging or inserting portion at a distance below cover 9*a*, said portion having the same plugging or insertion direction as the connecting pins 19*a*. The profile legs of mating connector 30 are directed downwards to connecting pins 19*a* and have a reciprocal internal spacing which is larger than the width of the zone on which the connecting pins 19*a* are located. Mating connector 30, which can also be used in place of positioning member 28 for the positionally correct orientation of the electric hotplate 1*a*, is used for mounting a connecting piece, which simultaneously has connecting members for receiving the connecting pins 19*a*.

In all the drawings the same reference numerals are used for corresponding parts, but in the different embodiments these numerals are followed by different letter reference.

In the embodiment according to FIGS. 4 to 7 a connecting piece 31 is provided, which in an insulator 32 made from steatite or the like has a plurality of parallel, immediately juxtaposed, electrically conductive connecting members 33 corresponding to the number of connecting pins 19b and which extend approximately over the entire length of insulator 32 and project freely over its front end. Appliance lines 34 are connected by crimped or clamping connections 35 to the rear ends of connecting members 33, said appliance lines 34 being flexible, i.e. easily bendable or bending-slack lines, which are optionally surrounded by a separate insulating jacket, which are aligned with the front ends of the connecting members 33 in the vicinity of the transition thereof into connecting piece 31. In the area behind the front, freely projecting ends the connecting members 33 are constructed in the manner of connector sockets and in this area approximately up to the connection of the appliance lines 34 are cross-sectionally U-shaped and the opening between the U-legs is covered by an inner face of the reception opening in insulating member 32, so that a connector socket opening 36 cross-sectionally closed over the circumference and partly bounded by connecting member 33 and partly by insulating member 32 is formed and its width is less than twice as large as the diameter of connecting pins 19*b*. The freely projecting front ends of the connecting members 33 constructed in the manner of multicore cable ends form threading-guidance means and for this purpose have a cross-sectional shape, which is not completely closed over the circumference. In the represented embodiment this cross-sectional shape is approximately rectangularly angular with a rounded transition zone between the angle legs, whose radius of curvature corresponds to that of the semicircular circular transverse web of said U-profile and is aligned therewith. A shorter angle leg 38 of said angle profile 37 is located in the connecting pins 19*b* and namely on its side remote from cover 9*b*, being aligned with the associated U-leg of connecting member 33, of which it forms a continuous extension. The other, longer angle leg 39 is at right angles thereto and is directed against the bottom of cover 9*b*, said angle leg 39 being formed by a correspondingly shaped end part of the other U-profile leg of connecting member 33 and passes in said profile leg via a smooth-surfaced, continuously curved guidance part 42 on the inside. The inner faces of angle legs 38, 39 form two guide surfaces 40, 41, which are at right angles to one another and pass into one another via a concave rounded portion, guide surface 41 passing in continuously curved manner into the inner face of guide portion 42 and passes in the same way as guide face 40 continuously into the associated inner faces of socket opening 36. Angle leg 38 is connected by its outer face to a shoulder surface 43 of insulator 32 covering the freely projecting ends of connecting members 33 or the angle profiles 37 over part of their length and which is formed by a corresponding projection passing through over the width of insulator 32. This projection or shoulder surface 43 is located on the side of connecting members 33 or angle profiles 37 remote from cover 9*b*, shoulder surface 43 possibly forming an extension of guide surfaces 40. The angle legs 38 or guide surfaces 40 of all the connecting members 33 in cross-section project in the same direction, i.e. the threading - guidance means are oriented in the same way in the case of all the connecting members.

FIG. 5 shows the electric hotplate 1*b* in its preferred fitting position, namely with the cooking surface 3*b* at the bottom and at 44 is indicated in dot-dash manner the hob 44 engaging in the support ring 15*b*. After joining together electric hotplate 1*b* and hob 44, connecting piece 31 is moved in parallel or aligned manner to connecting pins 19*b* using a not shown gripper. The gripper engages in two positioning members 45 of connecting piece 31 provided laterally on insulator 32 and which are formed by lateral cutouts or depressions, so that apart from a positionally correct mounting of connecting piece 31, also a positive connection in the insertion direction is ensured. Connecting piece 31 is so moved up to connecting pins 19b, that they still have a certain distance from the extensions of the guide surfaces 40, 41 considered in the insertion direction, i.e. in all cases come to rest in the angle or insertion space enclosed by the same. As soon as the guide surfaces 40, 41 have overlapped all the connecting pins 19*b* over an adequate length, the connecting piece 31 is moved at right angles to the plugging direction indicated by arrow 48 in two coordinate directions 46, 47 at right angles to one another, said coordinate directions being parallel or at right angles to the planes of guide surfaces 40, 41 and are directed in the direction at right angles to the associated guide surface 40 or 41 in which said guide surface points. Appropriately connecting piece 31 initially is moved in the coordinate direction 47 at right angles to guide surface 41 until connecting pins 19*b* strike against the associated guide surface 41, after which connecting piece 31 is moved in the coordinate direction 46 at right angles to guide surface 40 until connecting pins 19*b* also strike against said guide surface 40. Thus, connecting pins 19*b* are precisely aligned with respect to the socket openings 46, so that the connecting piece 31 can be fully mounted in the insertion direction of arrow 48 on the connecting pins 19*b* constructed as plugging pins, e.g. until the front ends of connecting members 33 or angle profiles 37 are located in the vicinity of bends 22*b*. During the movement in coordinate directions 46, 47, it is possible to interrupt the movement in the plugging direction of arrow 48 or it can be continued at such a low speed that in any case the threading of the connecting pins 19*b* in the socket openings 36 is ensured. Connecting pins 19*b* are then firmly connected within the connecting members 33, i.e. between their front and rear ends of between the front and rear end of insulator 32 to the said connecting members 33. This can e.g. take place in advantageous manner by noncontact welding, an access opening 49 being provided for this purpose on the side of insulator 32 remote from cover 9*b* in the vicinity of each connecting member 33. However, it is also possible to firmly connect the connecting members 33 in the vicinity of their freely projecting ends by welding, e.g by resistance welding to the connecting pins 19*b*.

Connecting piece 31 or insulator 32 is constructed in side view or in the plugging direction as a flat body of an approximately constant thickness, which in plan view is elongated—rectangular with juxtposed connecting members 33 arranged over its width. On the side facing cover 9*b*, insulator 32 is provided in the vicinity of its front end with projecting, stud-like locking members 50, with which are associated corresponding locking openings or cavities 51 in the bottom of reception depression 27*b*. The two locking openings 51, in a view of the underside of the hotplate according to FIG. 4, are located on either side of the group of connecting pins 19*b*. On mounting the connecting piece 31 on the connecting pins 19*b*, locking members 50 snap in the manner of stops into the locking openings 51, so that the insertion depth with which the connecting pins 19*b* engage in connecting piece 31 is precisely defined. The construction can be such that the locking members 50 are pressed by the spring tension of connecting pins 19*b* into the locking openings 51 and are thus secured in their locking position. In the connected state connecting piece 31, which slopes to the bottom of the electric hotplate 1*b* in accordance with connecting pins 19*b* projects a relatively long way over the outer circumference of flange edge 5*b* or hotplate body 2*b*, so that the appliance lines 34 are at a relatively large distance from the hotplate.

Bend 22, 22*a* or 22*b* of each connecting pin also forms an articulation zone in the form of a desired bending point, through which the connecting pin can be pivoted particularly about a central axis at right angles to axial plane 14 with respect to the remaining hotplate and preferably at least up to a position projecting at right angles over its underside. Thus, after fitting, the connecting piece can optionally be vertically positioned below insulating member 20*b*, the connecting pins appropriately only being bent after connection to the connecting piece. According to FIG. 8, this articulation zone 22 of lead 17*c* is formed by two immediately adjacent cross-sectionally weakened portions 52 on either side of the bend, said portions being formable by crimping or crushing the solid wire piece and have their smaller cross-sectional extension at right angles to the articulation axis. The cross-sectionally weakened portions can also be provided in juxtaposed manner adjacent to the bend at the associated end of the connecting pin, so that the bend and articulation zone are juxtaposed and do not coincide.

Figure 11:
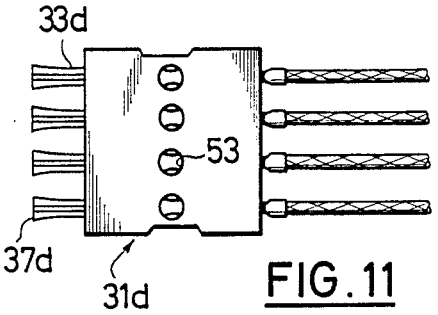
FIGS. 10 and 11 another embodiment of a connecting piece in representations corresponding to FIGS. 5 and 6.
Figure 10:
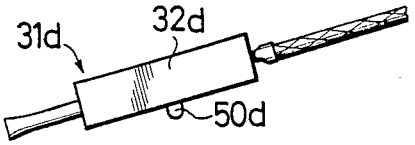

In the case of connecting piece 31*d* according to FIGS. 10 and 11, the connecting members 33*d* are formed by connector sockets projecting freely over the front end of insulator 32*d*, which are bent from sheet metal strips and are therefore longitudinally slotted. At a distance upstream of the front end of insulator 32*d*, the connecting members 33*d* have conical widened portions 37*d* as threading and guidance means for the connecting pins. At its associated side, the insulator 32*d* also has a stop 50*d*, which can strike against the outer circumference of the flange edge of the hotplate body and thereby fixes the insertion depth for the connecting pins. The projecting connecting members 33*d* are particularly suitable for joining to the connecting pins by spot welding or non-contact welding, such as laser welding. Between its front and rear ends, the insulator 32*d* is provided in the vicinity of each connecting member 33*d* passing through it with an engagement opening 53 for a crimping tool enabling the connecting members 33*d* to to be so deformed by crimping within the insulator 32*d* that they are positionally secured in the longitudinal direction with respect to insulator 32*d*. The engagement openings 53 can be juxtaposed on the side remote from the hotplate, on the side facing the same, or on both sides and are preferably aligned with one another in each case.

Figure 13:
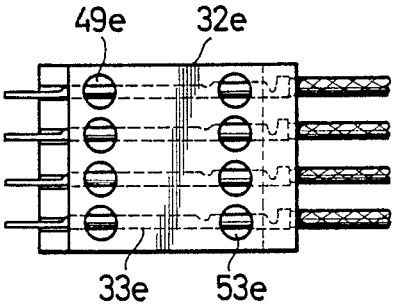
FIG. 13 the connecting piece according to FIG. 12 in a representation corresponding to FIG. 6.
Figure 12:
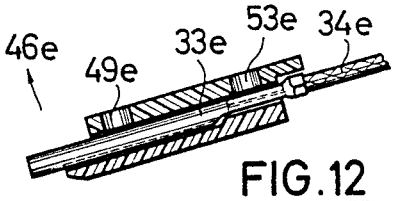
FIG. 12 another embodiment of a connecting piece in a sectional side view.
Figure 14:
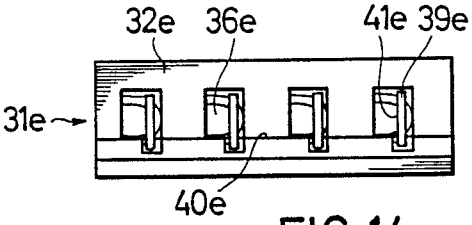
FIG. 14 the connecting piece of FIG. 12 in a view of the connecting end.
Figure 15:
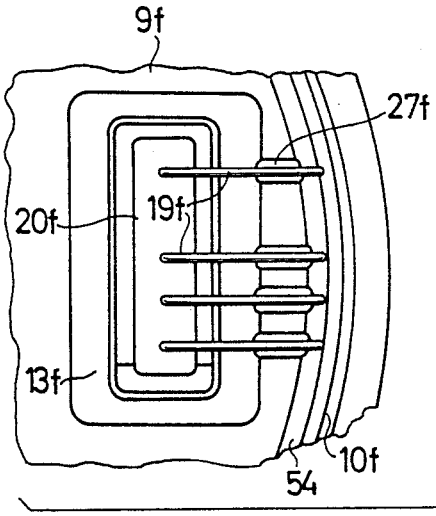
FIG. 15 another embodiment of a hotplate with the associated connecting piece in a view of the underside.
Figure 15:
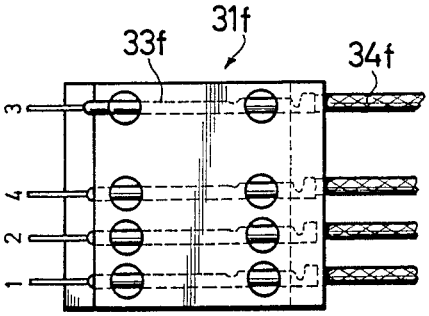

In the embodiment according to FIGS. 12 and 13 one guide surface 40*e*, namely the guide surface parallel to the common median plane of the connecting pins is formed by insulator 32*e* and namely by a shoulder surface, similar to shoulder surface 43 according to FIG. 7, passing approximately over its entire width. This shoulder surface is only interrupted by planar strip-like or lug-like extensions of connecting members 33*e*, which so engage in slot-like depressions in the shoulder surface, that the guide surfaces 40*e* are approximately aligned with the associated inner boundaries of the socket openings 36*e*, said inner boundaries being formed by the associated U-profile legs of the connecting members 33*e*. However, it is also conceivable to construct the connecting members 33*e* over the entire length to be engaged with the connecting pins, e.g. up to the connection of the applicance lines 34*e*, in the form of planar, strip-like connecting lugs, so that the socket opening is only bounded at a single point by the electrically conductive connecting member 33e and is otherwise bounded by the insulator 32e. Each guide surface 40e passes uninterruptedly between two guide and connecting lugs 39e, each lug 39e forming a guide surface 41e at right angles to guide surface 40e. In the represented embodiment, guide surfaces 40e, unlike in the embodiment according to FIGS. 5 to 7, are directed away from the bottom of the hotplate, so that the associated coordinate direction 46e is in the opposite direction. Apart from the access openings 49e for non-contact welding located adjacent to the front end of insulator 32e, the latter also has at least one engagement opening 53e for a crimping tool or the like for each connecting member 33e. The freely projecting ends of the connecting lugs 39e are suitable for joining to the connecting pins by resistance welding or the like.

Whereas in the embodiments according to FIGS. 1 to 14, the spacings between adjacent connecting pins or members are identical, in the embodiment according to FIG. 5 they are so asymmetrically unequal that the connecting piece 31f can only be connected thereto in a single predetermined position, thereby excluding connection errors due to an inverted mounting of connecting piece 31f. In a preferred embodiment, apart from one spacing, particularly located between two outer connecting members 33f, all the remaining spacings between adjacent connecting members 33f are equal, the differing spacing being larger than said other spacings. In the bottom of cover 9f is provided a separate, slot-like reception depression 27f for each connecting pin 19f and is provided in cover 9f between a relatively narrow circumferential slot 54 following on to ring rim 10f and the recess 13f for the insulating member 20f. Thus, each connecting pin 19f is secured against lateral movements and consequently possible corresponding bending during transportation and during stacked storage.

The connecting members 33h of connecting piece 31h according to FIGS. 16 and 17 form sleeve-like connector sockets, which are circumferentially closed and which project freely over the front end of insulator 32h, the inner bore thereof being conically widened at the front end in funnel-shaped or acute-angled manner. Connecting members 33h are appropriately formed by thick-walled pipe sections made from corrosion-resistant steel or some other high temperature-resistant, electrically conductive material and can be mechanically fixed to the connecting pins by squeezing together.

In the embodiment according to FIGS. 18 to 20, connecting members 33i are again formed by relatively thick-walled steel sleeves, which are widened in funnel-shaped manner by non-cutting working at their front ends for the purpose of forming threading and guidance means for the connecting pins. On their rear ends located in insulator 32i they are widened in oval or oval elliptical manner, so that their larger cross-sectional extension is at right angles to the common median plane of the connecting members 33i or the connecting pins. Threaded clamping screws 55 are guided in said portions in such a way that, in accordance with FIG. 23, they engage in the side flanks of the oval cross-section of connecting members 33i and are consequently particularly securely and reliably guided. Clamping screws 55 are used for connecting the appliance lines 34i, which are therefore detachably fixed. The connecting members 33i are connected by crimping to the connecting pins. Insulator 32i is fixed to a substantially U-shaped plugging or inserting member 56 bent from sheet metal and which can e.g. be constructed for mounting on the mating connector 50 of FIG. 3. Member 56, which partly embraces insulator 32i for position fixing purposes, projects in the plugging direction of arrow 48i over the connecting members 33i and can be provided in the vicinity of its front end with locking members 50i in the form of stampings. The inserting member 56 is located on the side of insulator 32i facing the hotplate and which it covers with respect to the latter.

In the embodiment according to FIGS. 21 to 23, the connecting members 33k are cross-sectionally oval or oval elliptical over their length, so that the connecting pins are also inserted in oval elliptical socket openings, whose larger cross-sectional extension is at right angles to the common median plane of the connecting pins. Clamping screws 57 are also provided for securing the connecting pins and upstream of insulator 32k are so fitted in exposed manner on the projecting ends of connecting members 33k, that they engage by their threads in parallel, planar inner flank faces of the connector socket openings.

Figure 25:
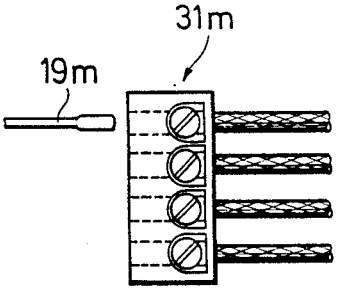
FIGS. 24 to 27 two further embodiments of connecting pieces in representations corresponding to FIGS. 5 and 6.
Figure 24:
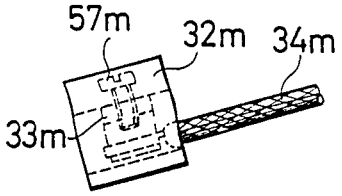

In the embodiment according to FIGS. 24 and 25, it is a question of a very short connecting piece 31m, whose insulator 32m completely receiving in countersunk manner the connecting members has a much larger width than its extension in the insertion direction and can be constructed in the manner of a porcelain insulator. Appropriately only one clamping screw 37m is provided on each connecting member 33m and jams the end of the associated connecting pin 39m, which has appropriately been widened by crimping, overlappingly against the associated end of the appliance line 34m and therefore directly against the same. This end of the tool line 34m can be fixed by welding or the like to connecting member 33m or it can be simultaneously detachably fixed to the connecting pin 19m by clamping screw 57m. Clamping screws 57 are also located in countersunk manner in insulator 32m. This construction is particularly suitable for transferring the connecting pins 19m into a position projecting roughly at right angles from the underside of the hotplate, so that the connecting piece 31m and the appliance line 34m if permitted by the space conditions under the hob, can be located a relatively long way below the electric hotplate.

Figure 27:
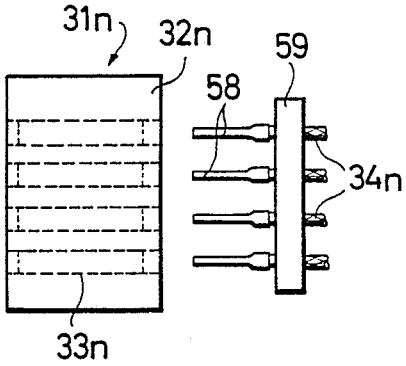
Figure 26:
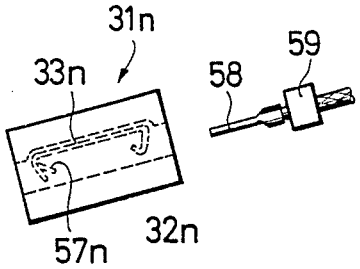

As shown in FIG. 26 and 27, the connecting members 33n can also be constructed in such a way that they are connected to the connecting pins by a preferably self-locking plug connection. In the represented embodiment, each connecting member 33n is formed by an approximately U-shaped sheet metal profile whose leg directed towards the front of the connecting piece 31n has an insertion opening for the particular connecting pin. This insertion opening can be bounded by a barb-like locking member 57n, which is so hooked in the connecting pin that it does not release the same counter to the insertion direction. In the opposite leg of connecting member 33n, there is appropriately an insertion opening for a connector 58 fitted to the appliance line 34n in such a way that it can be detachably inserted. All the appliance lines 34n are fixed in positionally correct manner to a web-like joining piece 59 adjacent to their associated ends or connectors 58, so that they can be connected as a block to connecting piece 31n.

Figure 28:
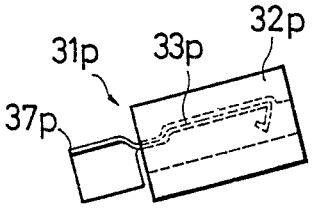
FIG. 28 another embodiment of a connecting piece in side view.

The embodiment according to FIG. 28 differs essentially in that the front ends of the connecting members 33p associated with the connecting pins are formed by angle profiles 37p or similar threading and guidance means located freely upstream of insulator 32*p*, so that the connecting pins can be joined by welding.

Figure 29:
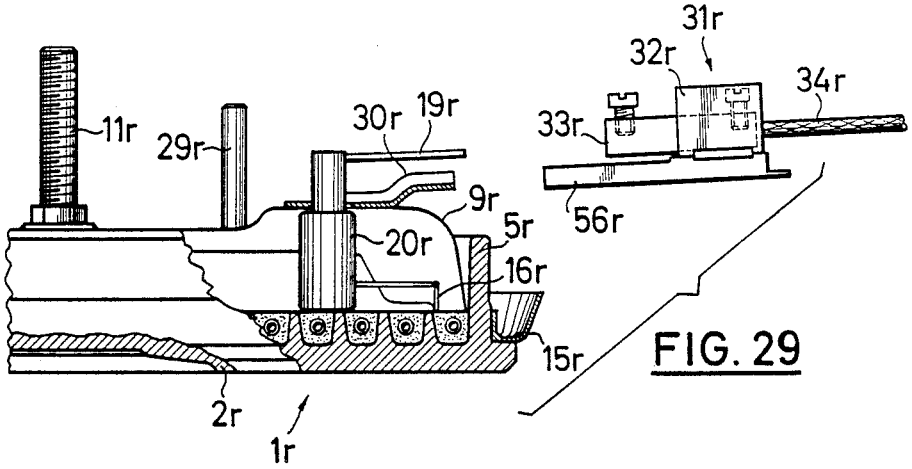
FIG. 29 another embodiment of a hotplate with associated connecting piece in a representation corresponding to FIG. 5.
Figure 30:
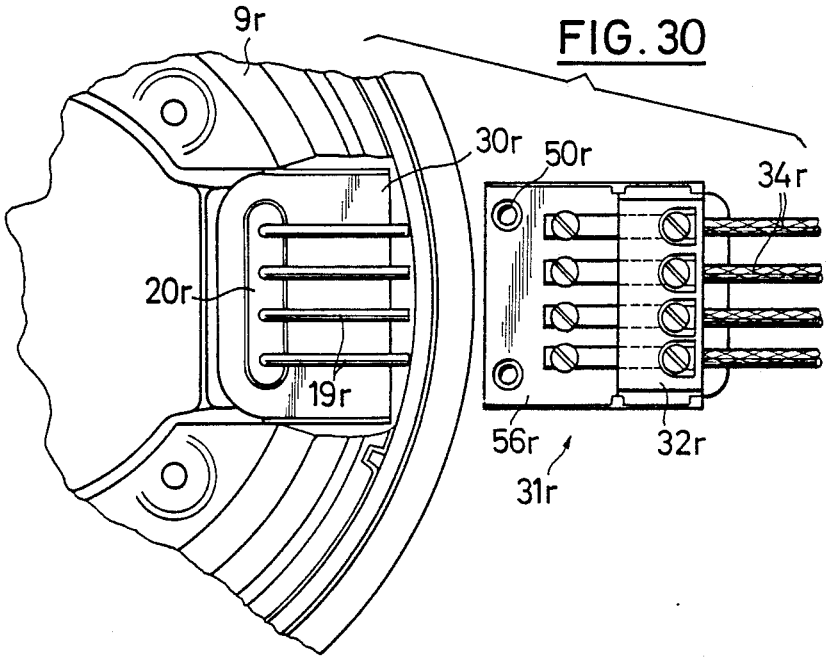
FIG. 30 the arrangement according to FIG. 29 in a view of the bottom of the hotplate.
Figure 36:
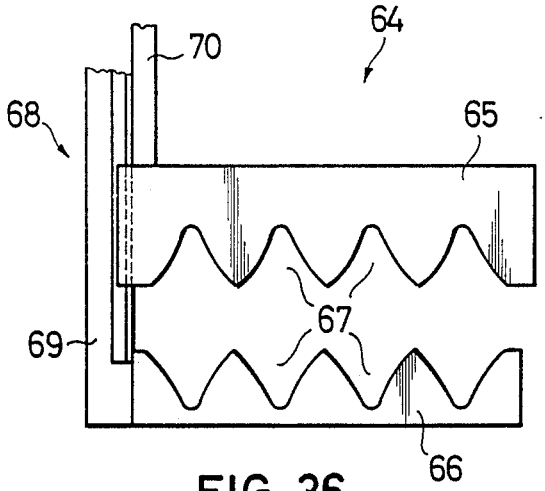
FIG. 36 a tool according to the invention for positioning the connecting portions of the electric hotplate during the connection of these connecting portions with the connecting members respective the connecting piece shown in a front view and an opened condition, FIG. 37 the tool according to FIG. 36 in closed condition, FIG. 38 a further embodiment of a tool shown in a view according to FIG. 36.
Figure 37:
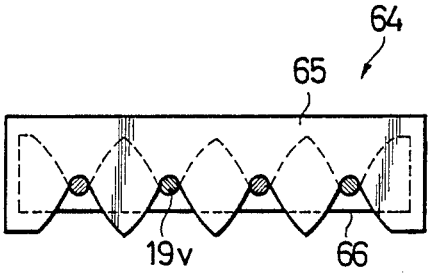
Figure 38:
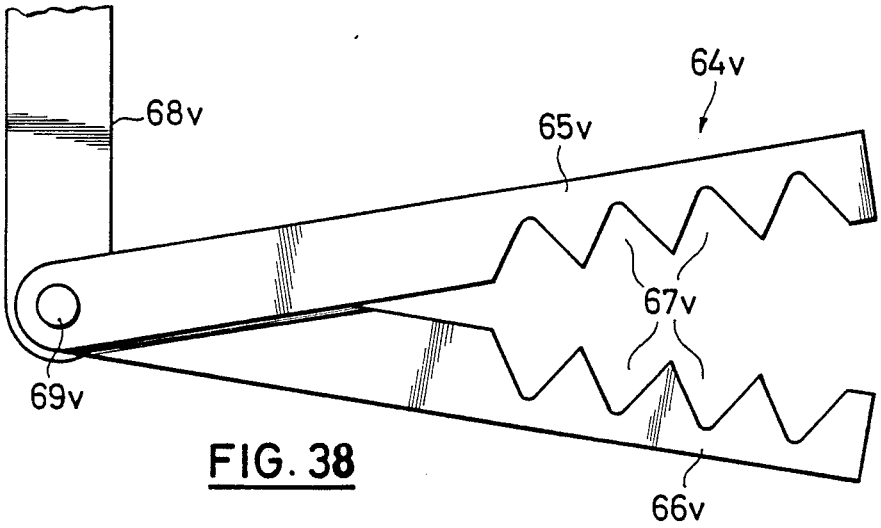

FIGS. 29 and 30 show the association of the connecting piece 31*r* to the electric hotplate 1*r* or to a mating connecting 30*r*, whereby hotplate 1*r* is similar to that of FIG. 3 and the connecting piece 39*r* essentially corresponds to that of FIGS. 21 to 23. Connector 56*r* is arranged in such a way that between its relatively narrow legs directed away from the underside of the hotplate, it receives the mating connector 30*r* and is consequently secured against lateral displacements with respect to the same. According to FIG. 30, locking members 50*r* can be provided on connector 56*r* and cooperate with corresponding, not shown counter-members in the mating connector 30*r*. By means of connector 56*r*, which can be engaged with the mating connector 30*r* before the connecting members 33*r* engage with the connecting pins 19*r*, the connecting members 33*r* are very accurately aligned with respect to the connecting pins 19*r* in two coordinate directions at right angles to one another.

In the embodiment according to FIGS. 31 and 32, the free end of mating connector 30*s* carries a plate-like centering member 60 constructed in one piece with the mating connector 30*s* and which is used for all the connecting pins 19*s*, whereby in the centring position, said centering member 60 is in a plane approximately at right angles to connecting pins 19*s* and is directed downwards away from hotplate 1*s*. Centering member 60, which is provided with an undercut centering opening 61 for each connecting pin 19*s* on its lower longitudinal edge and which in the vicinity of said longitudinal edge forms a lead-out opening adapted to the diameter of connecting pin 19*s* and which is narrower than the remaining width of centering opening 61, engaegs with a limited distance behind the free ends of the connecting pins 19*s*. In the vicinity of its side remote from the centering opening 61, centering member 60 is connected in one piece with the front end of mating connector 30*s* by means of an articulation zone 63 in the form of relatively weakly dimensioned connecting webs, the articulation axis being located in the plane of the underside of mating connector 30*s*, so that the centering member 60 can be flapped against said underside. Connecting pins 19*s* then pass out of the centering opening 61 through the lead-out opening 62. Connector 56*s* of connecting piece 31*s* can be so shortened with respect to connecting members 33*s*, that the latter firstly engage with the connecting pins 19*s*. The connecting members 33*s* and particularly connector 56*s* then strike against the centering member 60, so that it is flapped against the bottom of mating connector 30*s* and is then located between said bottom and connector 56*s*, so that it cannot electrically bridge the connecting members 33*s*. Thus, in this case the connector 56*s* is located between the lateral profile legs of the mating connector 30*s* on the bottom surface thereof. Gripping jaws of an apparatus for connecting the hotplate can be constructed corresponding to the centering member, but appropriately have prismatic centering openings, i.e. widened towards the lead-out openings and which are e.g. V-shaped and two oppositely directed gripping jaws can be provided.

In the embodiment according to FIGS. 31 to 33, the centering openings 61 of the connecting link-like centering member 60 are dovetailed. Centering openings 61*t* can also be angular in accordance with FIG. 33, so that they are bounded by angular fixing clips and the centering opening 61*t* is substantially slightly laterally displaced with respect to the lead-out opening 62*t*. However, this is also the case in the embodiment according to FIG. 35, in which the centering openings 61*u* are formed by sloping, slot-like openings with approximately continuous, planar lateral faces, which have a constant spacing over their height or which can have a reducing spacing to the lead-out openings 62*u*. The features described relative to the individual embodiments can also be provided in all the other embodiments, as a function of the requirements to be fulfilled in each case. In the case of use on a so-called automatic hotplate, in which a heat sensor is provided in an opening in the centre of the hotplate body, there are appropriately two hollow screws with an internal thread, which are spaced outside the central axis of the hotplate corresponding to the hollow screw 11 according to FIGS. 1 and 2 both for fixing the cover and for fixing and preventing the rotation of the hotplate on the appliance. In place of the described connecting possibilities between the connecting members 33 etc. and the appliance lines 34, in all the embodiments it is possible to provide on the connecting members flat insertion tongues for the plug junctions, as are marketed under the trade name AMP. Instead of the alignment by means of the centering members 60 or additionally thereto, the aligning of the connecting pins, for example the connecting pins 19, 19*s*, respective 19*v* during the fitting respective the assembling may take place also by the means of providing a separate aligning or centering tool 64 appropriately provided as a gripper for separately grip the connecting pins 19*v*, so that these are as well aligned parallel to each other as held in predetermined distances with respect to each other. The tool according to FIG. 40 and 41 comprises two comb-shaped gripping jaws 65, 66, to be brought into an intermashing equipment, which either are positioned directly adjacent behind each other and overlap each other or from which a thicker gripping jaw has a reception slot on its comb edge for receiving the other, thinner respective plate-like gripping jaw. The gripping jaws 65, 66 are provided with gripping cutouts 67 formed and arranged according to the centering member 60 and facing each other with their open sides, the gripping cutouts, for example, having convex curved flanks funnel-like narrowed to their bottom faces, whereby the bottom faces substantially correspond to the half cross-section of connecting pins 19*v*. The gripping jaws 65, 66 project freely from one end respective from a gripper holding means 68 in a direction in which the gripping cutouts 67 are provided adjacent to each other and are mounted movable towards and away from each other with respect to the gripper holding means 68. In the embodiment shown in the drawings, only one gripping jaw 65 is mounted movable for closing the tool whilst the other gripping jaw 66 is fixedly attached to the gripper holding means 68. In engagement with the respective movable gripping jaw 65, there is provided a setting member 70, for example, formed by a setting rod guided on a rod-like jaw guide 69. The tool 64 is moved in opened condition from a lateral position in such a way into the connecting pins (19*v*), that these come to lie between the gripping jaws 65, 66 and that between each two adjacent connecting pins 19*v*, the two corresponding comb teeth will be arranged, these comb teeth being oppositely disposed with respect to each other and lying between two adjacent gripping cutouts 67 of the respective gripping jaw 65, 66, thereby forming the flanks of the gripping cutouts 67. During transferring the tool into the closing position according to FIG. 41 the connecting pins 19*v* slide on the flanks of the gripping cutouts 67 until they lie in contact with the two oppositely disposed bottom faces of the two oppositely disposed gripping cutouts 67 and are held substantially free from motion play by clamping. Since the free ends of the connecting pins 19*v* project over the tool 64 these ends can adapt their position still by a small amount and resiliently with respect to the position of the connecting piece or the position of the connecting members during threading into the connecting piece.

Whilst in the embodiment according to FIG. 40 and 41 the gripping jaws 65, 66 are movable linear with respect to each other, the gripping jaws 65*v*, 66*v* in the embodiment according to FIG. 42 are pincer-like swivel-mounted with respect to each other. For this purpose, both of the gripping jaws 65*v*, 66*v* form pliers arms elongated beyond the gripping openings or gripping cutouts 67*v*, the pliers arms being turnable mounted on each other as well as on the gripper holding means 68*v* about an axis parallel to the middle axis of the gripping cutouts 67*v* in a hinge 69*v* provided at their ends positioned at a distance from the gripping cutouts 67*v*. There also may be separate pincers provided for each connecting pin so that several pincers arranged adjacent to each other can engage into the connecting pins from the bottom side of the electric hotplate and at right angles thereto. In this case, the pincers can catch the connecting pins very closely to the insulating member since the pincers need only very little space betwen the connecting pins and the bottom side of the electric hotplate.

What is claimed is:

1. An electric hotplate comprising:

a hotplate body (20) having an outer circumference, a bottom side, and at least one heating resistor (7);

a bottom cover (9) for said hotplate body (2);

an insulating member (2) providing a passage for connecting leads (17) of the heating resistor (7), said connecting leads forming connecting portions accessible on the bottom side of the hotplate (1), said connecting portions providing connection ends constructed for connection of appliance leads (34), wherein the connecting leads (17), at least from passage thereof through the insulating member (20) are constructed as one-part, inherently rigid, but resiliently movable pin members forming substantially straight connecting pins (19), freely projecting ends of said connecting pins being directed substantially parallel outwards towards the circumference of the hotplate body (1), said connecting pins the extending at most to an outer circumference of the hotplate body (2).

2. An electric hotplate according to claim 1, wherein said hotplate body (2) has an outer flange rim (5) projecting to the bottom side the defining an outer circumference, said connecting pins (19) extending to the outer flange rim (5) of the hotplate body (2).

3. An electric hotplate according to claim 2, wherein the bottom cover (9) has an outer ring rim (10) defining an offset rim width, the connecting pins (19) being set back from the outer circumference of the outer flange rim (5) of the hotplate body by at least the rim width of the outer ring rim (10) of the bottom cover (9).

4. An electric hotplate according to claim 3, wherein said said ring rim (10) engages over an underside of the flange rim (5) of the hotplate body (2).

5. An electric hotplate according to claim 1, wherein the bottom cover (9*f*) has at least one reception depression (27*f*) for the connecting pins (19*f*).

6. An electric hotplate according to claim 1, wherein the bottom cover has a separate slot-shaped reception depression (27*f*) for each connecting pin (19*f*).

7. An electric hotplate according to claim 5, wherein the reception depression (27*f*) is provided in an area between a circumferential slot (54) following on to the ring rim (10*f*) and a recess (13*f*) on the bottom side of the bottom cover for receiving the insulating member (20*f*).

8. An electric hot plate according to claim 7, wherein the underside of the ring rim defines a plane and the area is disposed in the plane and centrally relative to the bottom cover.

9. An electric hotplate according to claim 1, wherein at least in a transportation position, the connecting pins (19) extend downwards at the most up to the bottom side of the hotplate (1).

10. An electric hotplate according to claim 5, wherein at least in a transportation position, the connecting pins (19) are resiliently pressed into the reception depression (27).

11. An electric hotplate according to claim 1, wherein in a relaxed state, the connecting ends of connecting pins (19) slope downwards.

12. An electric hotplate according to claim 1, wherein at least the connection ends of the connecting pins (19) have substantially identical spacings from the bottom side of the hotplate (1).

13. An electric hotplate according to claim 1, wherein all connecting pins (19) are provided in a common plane.

14. An electric hotplate according to claim 1, wherein the connecting leads (17) are formed by one-part, bent, temperature-resistant solid wire pieces.

15. An electric hotplate according to claim 1, wherein the connecting leads are made from a chromium-nickel alloy from a direct connection to the heating resistors (7) at end pins (16) thereof up the connecting ends of the connecting pins (19) and bent directly in the vicinity of an underside of the insulating member (20).

16. An electric hotplate according to claim 1, wherein the particular connecting pin (19) has an articulation-defining bending point adjacent to the insulating member (20).

17. An electric hotplate according to claim 16, wherein the bending part is formed by two cross-sectionally weakened portions (52) on either side of the bending point.

18. An electric hotplate according to claim 1, wherein the connecting pins (19) are at least substantially transferable into a position at right angles to the hotplate.

19. An electric hotplate according to claim 1, wherein different, asymmetrically distributed spacings are provided between adjacent connecting pins (19*f*).

20. An electric hotplate comprising:

a hotplate body (2) having an outer circumference, a bottom side, and at least one heating resistor (7);

a bottom cover (9) for said hotplate body (2);

an insulating member (20) providing a passage for connecting leads (17) of the heating resistor (7), said connecting leads (17) forming connecting portions accessible from the bottom side of the hotplate (1), said connecting portions having freely projecting connecting pins with connection ends constructed for connection to appliance leads (34), wherein a connecting piece (31) is associated with the appliance leads, said connecting piece (31) forming a part separate from the hotplate, said connecting piece being common for all the connecting portions (19*b*), said connecting piece (31) having separate connecting members (33) juxtaposed on an insulator (32) and further having threading and guidance means for the freely projecting connecting pins of the connecting portions, the threading and guidance means being located in a vicinity of access-side ends provided on the connecting members.

21. An electric hotplate according to claim 20, wherein the connecting members (33) respective the insulator (32) form connector sockets for the connecting pins and in the vicinity of front ends of the sockets have cross-sectional shapes forming the threading and guidance means.

22. An electric hotplate according to claim 20, wherein a front end of a socket opening (36*h*) of at least one connecting member is widened in funnel-shaped manner.

23. An electric hotplate according to claim 20, wherein a front end of a socket opening (36*h*) of at least one connecting member is formed by the tubular respective longitudinally slotted, sleeve-like connecting member (33*h* or 33*d*).

24. An electric hotplate according to claim 21, wherein the socket opening (36*k*) of the connector socket is oval elliptical and substantially at right angles to a common plane of the connecting pins.

25. An electric hotplate according to claim 20, wherein in front of a socket opening (36) of at least one connecting member is provided at least one guide surface (40, 41) for the connecting end of the connecting pins (19*b*), said guide surface being substantially parallel to an insertion direction (arrow 48) of the connecting piece and wider than the socket opening (36).

26. An electric hotplate according to claim 25, wherein one guide surface (40*e*) is substantially parallel to the common plane of the connecting pins and provided on a side remote from the bottom side of the hotplate.

27. An electric hotplate according to claim 25, wherein one guide surface (41) is substantially at right angles to the common plane of the connecting pins, two guide surfaces (40, 41) being provided at an angle to one another and being connected and passing in a smooth-surface manner into one another and into the inner face of the socket opening (36).

28. An electric hotplate according to claim 25, wherein at least one guide surface (40, 41) is formed by the connecting member (33) having a front end of flat bar-like respective angular shape.

29. An electric hotplate according to claim 25, wherein at least one guide surface (40*e*) is formed by the insulator (32*e*).

30. An electric hotplate according to claim 25, wherein at least one guide surface (40*e*) is formed by a shoulder surface passing over all the connecting members (33*e*).

31. An electric hotplate according to claim 20, wherein the insulator (32, 32*e*) of the connecting piece (31, 32*d*, 31*i*) is connected to at least one aligning member engaging directly into the bottom side of the hotplate.

32. An electric hotplate according to claim 31, wherein the aligning member is formed by projecting studs for engagement in depressions (51) on the underside of the bottom cover (9*b*).

33. An electric hotplate according to claim 31, wherein the aligning members are provided on either side of the connecting pins (19*b*).

34. An electric hotplate according to claim 31, wherein the aligning member is formed by a stop (50*d*) for engaging on the outer circumference of an outer flange rim of the hotplate body.

35. An electric hotplate according to claim 20, wherein the insulator of the connecting piece is supported on the flange rim in its stop position and projects outwards over the flange rim by part of its total length.

36. An electric hotplate according to claim 31, wherein the aligning member is formed by a connector plug (56*r*) substantially parallel to the connecting pins (19*r*) and associated with a mating connector (30*r*) of the hotplate (1*r*).

37. An electric hotplate according to claim 36, wherein the connector plug (56*r*) is formed by a sheet metal profile carrying the insulator (32*r*) and the mating connector (30*r*) is formed by an insertion tongue located above the connecting pins (19*r*) and fixed to the bottom cover (9*r*).

38. An electric hotplate according to claim 1, wherein a centering member (60) for the connecting pin (19*s*) is provided for engaging the connecting pin in the vicinity of a connection end, said centering member being arranged on the hotplate (1*s*).

39. An electric hotplate according to claim 38, wherein the centering member (60) is movable from its centering position into a connecting position displaced from an insertion path of the connecting piece (31*s*) for connecting to the connecting pins (19*s*).

40. An electric hotplate according to claim 38, wherein the centering member (60) is mounted for being moved out of the centering position by the connecting piece (31*s*) in substantially the insertion direction thereof.

41. An electric hotplate according to claim 38, wherein the centering member is pivotably mounted about an axis substantially parallel to the common plane of the connecting pins (19*s*).

42. An electric hotplate according to claim 38, wherein the centering member is arranged on the bottom cover (9*s*).

43. An electric hotplate according to claim 38, wherein the centering member is connected by means of determined bending articulation zones (63) to the mating connector (30*s*).

44. An electric hotplate according to claim 38, wherein the centering member (60) has centering openings (61) for engaging the connecting pins (19*s*), said centering openings being open at an edge of the centering member (60), thereby forming escape openings (62) for the connecting pins (19*s*).

45. An electric hotplate according to claim 44, wherein the escape openings are provided on the edge of the plate-like centering member (60) remote from the articulation zone (63).

46. An electric hotplate according to claim 20, wherein, the connecting piece (31) has at least one positioning member (45) for a positionally correct alignment on a gripper of a robot means.

47. An electric hotplate according to claim 46, wherein the positioning member is substantially formed by positioning depressions provided on either side of the insulator (32).

48. An electric hotplate according to claim 20, wherein the connecting members (33) are made from steel.

49. An electric hotplate according to claim 20, wherein the connecting members (3) are formed by multicore cable ends for the connection to the appliance lines (34).

50. An electric hotplate according to claim 20, wherein the connecting members (33*d*) are secured in position with respect to the insulator (32*d*) by crimping, the insulator in the vicinity of each connecting member (33*d*) being provided with at least one engagement opening (53) for a crimping tool, said engagement opening being located substantially at right angles to the connecting member.

51. An electric hotplate according to claim 20, wherein at least one connecting member (33) is constructed for non-contact welding to the connecting pin (19*b*), the insulator having an access opening (49) in the vicinity of a respective welding point.

52. An electric hotplate according to claim 20, wherein at least one connecting member (33*h*) is constructed for crimped connection to the connecting pin respective the appliance line (34*h*).

53. An electric hotplate according to claim 20, wherein at least one connecting member (33*n*) is constructed for a detachable plug connection to the connecting pin respective a connector (58) of the appliance lines (34*n*).

54. An electric hotplate according to claim 20, wherein at least one connecting member (33*k*) for the connecting pin respective for the appliance line (34*k*) has at least one connecting clamping screw (57 or 55*k*), whereby in the case of an oval socket cross-section of the connecting member (33*k*) a thread of the clamping screw engages opposite longer cross-sectional flanks of the connecting member (33*k*) and is positioned substantially parallel to these flanks.

55. An electric hotplate according to claim 20, wherein the connecting members (33) are provided with flat insertion tongues on their access-side ends.

56. An electric hotplate according to claim 20, wherein the connecting member (33) is projecting over the insulator (32) in the insertion direction (arrow 48) and extends substantially up to a bend (22*b*) of the connecting pin (19*b*).

57. An electric hotplate according to claim 20, wherein the insulator is elongated in a longitudinal direction of the connecting members (33), each connecting member being constructed in one piece, the insulator (32) being constructed as a flat body.

58. An electric hotplate according to claim 20, wherein the insulator (32) respective the insulating member (20*b*) is made from a ceramic material, like steatite.

59. An electric hotplate according to claim 1, wherein the insulating member (20) is positionally secured between the bottom cover (9) and a facing bottom side of the hotplate body (3) receiving an electric heating resistor (7), the insulating member (20) engaging in centered manner in a window-like opening (23) in the bottom cover (9).

60. An electric hotplate according to claim 1, wherein the insulating member (20) is set back with respect to an underside of the bottom cover (9).

61. An electric hotplate according to claim 1, wherein the insulating member (20) in narrow passage openings (21) secures the connecting leads (17) against movements of inner portions (18) associated with the heating resistors (7).

62. An electric hotplate according to claim 1, wherein the bottom side of the hotplate respective the bottom cover (9) is constructed as a stacking surface substantially located in one plane, the bottom side being substantially free from projecting parts and located in the plane of the ring rim (10).

63. An electric hotplate according to claim 1, wherein the hotplate, constructed as an automatic hotplate, is provided on its bottom side with two spaced fixing bolts for fixing the bottom cover respective the hotplate in a cooking range.

64. An electric hotplate according to claim 63, wherein the fixing bolts are hollow screws.

65. An apparatus for assembling electric hot plates as recited in claim 25, comprising: a gripper for releasably clamping one of said connecting pieces; and, means for moving the gripper and connecting piece in accordance with a three dimensional coordinate system relative to the connecting pins to effect engagement of the connecting pins with the at least one guide surface.

66. An apparatus for assembling electric hot plates as recited in claim 1, comprising means for releasably gripping and aligning the connecting pins.

67. An apparatus according to claim 65, wherein the gripper comprises two gripping jaws at least one of said jaws having a comb-like gripping surface with centering cutouts for engaging the connecting pins.

* * * * *

UNITED STATES PATENT AND TRADEMARK OFFICE

CERTIFICATE OF CORRECTION

PATENT NO. : 4,818,846

DATED : April 4, 1989

INVENTOR(S) : Kicherer et al.

It is certified that error appears in the above-identified patent and that said Letters Patent is hereby corrected as shown below:

In the Abstract, line 3 delete "Our" and insert --Out-- .

Column 13, line 34 delete "engaegs" and insert --engages--.

Column 15, line 67 delete "said" (second occurrence).

Signed and Sealed this

Twenty-sixth Day of February, 1991

*Attest:*

HARRY F. MANBECK, JR.

*Attesting Officer*

*Commissioner of Patents and Trademarks*